US010576479B2

(12) United States Patent
Cai et al.

(10) Patent No.: US 10,576,479 B2
(45) Date of Patent: Mar. 3, 2020

(54) NET WATER OUTLET DEVICE

(71) Applicant: XIAMEN SOLEX HIGH-TECH INDUSTRIES CO., LTD., Xiamen, Fujian (CN)

(72) Inventors: Yongchuan Cai, Fujian (CN); Donghai Chen, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 127 days.

(21) Appl. No.: 15/710,313

(22) Filed: Sep. 20, 2017

(65) Prior Publication Data

US 2018/0353978 A1 Dec. 13, 2018

(30) Foreign Application Priority Data

Jun. 7, 2017 (CN) ..... 2017 1 0422849

(51) Int. Cl.

| | |
|---|---|
| ***B05B 1/18*** | (2006.01) |
| ***B05B 1/26*** | (2006.01) |
| ***B05B 1/02*** | (2006.01) |
| ***B05B 3/04*** | (2006.01) |
| *B05B 13/04* | (2006.01) |

(52) U.S. Cl.

CPC ..... *B05B 1/185* (2013.01); *B05B 1/02* (2013.01); *B05B 1/26* (2013.01); *B05B 1/267* (2013.01); *B05B 3/0422* (2013.01); *B05B 13/0421* (2013.01)

(58) Field of Classification Search

CPC .. B05B 1/185; B05B 1/18; B05B 1/26; B05B 1/267; B05B 3/0422; B05B 3/0421

See application file for complete search history.

(56) References Cited

U.S. PATENT DOCUMENTS

D826,376 S * 8/2018 Romero ..... D23/213
2010/0213289 A1* 8/2010 Huang ..... B05B 3/0422 239/587.1

* cited by examiner

*Primary Examiner* — Arthur O. Hall
*Assistant Examiner* — Tuongminh N Pham
(74) *Attorney, Agent, or Firm* — Cooper Legal Group, LLC

(57) ABSTRACT

A net water outlet device includes a main body and an outlet cover plate. The outlet cover plate is disposed at one end of the main body, the other end of the main body is an inlet end. The outlet cover plate is disposed with a first outlet hole group and a second outlet hole group arranged concentrically; therein, the outlet direction of the first outlet holes are configured so that: the axis of the outlet cover plate projects to the circumference of each first outlet hole, making the axis of the outlet cover plate and the tangent line of the circumference of each first outlet hole jointly define a first plane, the outlet direction of the first outlet holes are in the first plane, forming a first intersection angle with the projection of the axis of the outlet cover plate.

13 Claims, 9 Drawing Sheets

NET WATER OUTLET DEVICE

FIELD OF THE INVENTION

The present invention relates to an outlet device.

BACKGROUND OF THE INVENTION

Ever since the shower came out, an outlet device with various outlet water types, like column water, mist water, splashing water, is the main researching and developing direction of the company. The present invention is provided with a new water type outlet device based on this.

SUMMARY OF THE INVENTION

The main object of the present invention is to provide with an outlet device with interlaced net water outlet effect.

The technical proposal of the present invention is that:

A net water outlet device, wherein comprising a main body and an outlet cover plate;

the outlet cover plate is disposed at one end of the main body, the other end of the main body is an inlet end; the outlet cover plate is disposed with a first outlet hole group and a second outlet hole group arranged concentrically;

therein, the outlet direction of the first outlet holes are configured that: a projection forms by the axis of the outlet cover plate projecting to a circumference the first outlet holes define, and the projection and a tangent line of each first outlet hole define a first plane, the outlet direction of each first outlet hole is in the first plane, forming a first intersection angle with the projection of the axis of the outlet cover plate;

the outlet direction of the second outlet holes are configured that: a projection forms by the axis of the outlet cover plate projecting to a circumference the second outlet holes define, and the projection and a tangent line of each second outlet hole define a second plane, the outlet direction of each second outlet hole is in the second plane, forming a second intersection angle with the projection of the axis of the outlet cover plate;

the first intersection angle and the second intersection angle are opposite with respect to the projecting direction of the axis.

In another preferred embodiment, the angle of the first intersection angle and the angle of the second intersection angle are the same or not the same.

In another preferred embodiment, the first intersection angle is 7°, the second intersection angle is 4°.

In another preferred embodiment, the outlet direction of the first outlet hole is in the first plane and inclines to the next first outlet hole in the clockwise direction; the outlet direction of the second outlet hole is in the second plane and inclines to the next second outlet hole in the counter-clockwise direction.

In another preferred embodiment, the main body is disposed with a flowing driving device, which is coaxially linked to the outlet cover plate; the flowing driving device is driven to rotate by water flowing, such to drive the outlet cover plate to rotate axially.

In another preferred embodiment, the flowing driving device comprises an impeller and a reducing mechanism; the impeller rotates in a first rotating rate by the driving of the water flowing, the reducing mechanism rotates in the first rotating rate and drives the outlet cover plate to rotate in a second rotating rate lower than the first rotating rate.

In another preferred embodiment, the reducing mechanism comprises a fixing base, a gear and an output gear plate; the gear is linked to the impeller, the impeller rotates to drive the gear to rotate;

the fixing base and the output gear plate are respectively disposed with a first annular gear and the second annular gear in the circumference; the gear is engaged to the first annular gear and the second annular gear; the gear rotates and walks along the arrange direction of the first gear rack, the gear drives the output gear plate to axially rotate during the walking;

the output gear plate is disposed with an output shaft linked to the outlet cover plate at the axis.

In another preferred embodiment, the fixing base is disposed with a chamber, the chamber is disposed with a first cavity and a second cavity connected to each other in the axial direction, the impeller is disposed in the first cavity, the first annular gear is disposed along the inner circumference of the second chamber.

In another preferred embodiment, the output gear plate is disposed at the lower end of the second cavity in the axial direction; the second annular gear is disposed along the inner circumference of the output gear plate;

The gear is disposed with a first gear and a second gear overlapped in the axial direction, the first gear is engaged to the first annular gear, the second gear is engaged to the second annular gear.

In another preferred embodiment, the gear is disposed with an insert hole in the axial direction, the impeller is disposed with an insert column faced to the gear to couple to the insert hole; with the insert hole and the insert column, the impeller rotates and drives the gear to rotate.

In another preferred embodiment, further comprising a waterway guiding component;

water is divided to at least two waterways through the waterway guiding component, the at least two waterways impact and disperse before flowing to the outlet cover plate.

In another preferred embodiment, the waterway guiding component is disposed with a plurality of waterway guiding units rotatably symmetrically arranged;

each waterway guiding unit comprises an inlet and at least two outlets, the outlets are corresponding to the first outlet hole or the second outlet hole of the outlet cover plate; the waterway guiding unit comprises a diversion passage and a converging passage; water flowing from the inlet to the diversion passage is divided and then converges from different directions to the converging passage, the converging passage is disposed with a flowing hole connected to the outlet;

water from different directions to the conversing passage impacts in the flowing hole and then flows to the outlet.

In another preferred embodiment, the waterway guiding unit comprises three outlets rotatably symmetrically arranged, the inlet is disposed at the circle center; the diversion passage is disposed between the outlets and is connected to the inlet; the converging passage surrounds the three outlets, and is connected to the diversion passages respectively.

Compared to the existing known technology, the technical proposal of the present invention has advantages as follows:

1. The present invention is provided with a net water outlet device that the first outlet hole group and the second outlet hole group are concentrically arranged; the outlet direction of the two outlet hole groups are different, forming an interlaced outlet effect.
2. The net water outlet device of the present invention is provided that the outlet direction of each outlet hole of the first outlet hole group and the second outlet hole group inclines to a same direction with the next outlet hole of the same outlet hole group, and is arranged in the circumference with the same outlet angle, making the outlet effect attractive.

3. The net water outlet device of the present invention is provided that the flowing driving device drives the outlet cover plate to rotate such to achieve rotatable interlaced outlet effect.
4. The net water outlet device of the present invention is provided that to improve the cover area of the interlaced outlet, the waterway guiding component is configured to divide first and then converge the water of the first outlet hole group and the second outlet hole group, making the water impact and disperse, thus increasing the cover area of the outlet water, making the outlet device available in a large shower device, for example, a top spraying shower head.

DETAILED DESCRIPTION OF THE EMBODIMENTS

Figure 1:
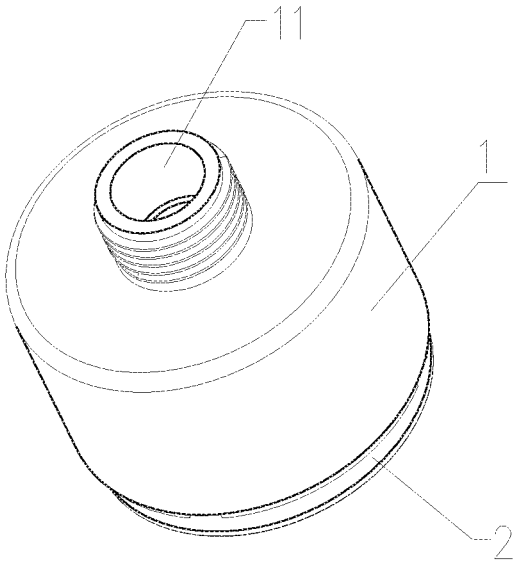
FIG. 1 illustrates a schematic diagram of the first embodiment of the present invention.
Figure 2:
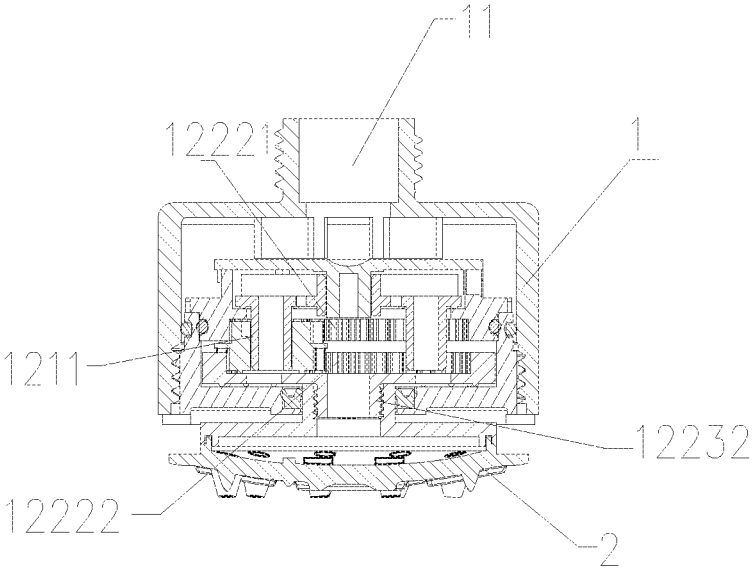
FIG. 2 illustrates a sectional diagram of the first embodiment of the present invention.
Figure 3:
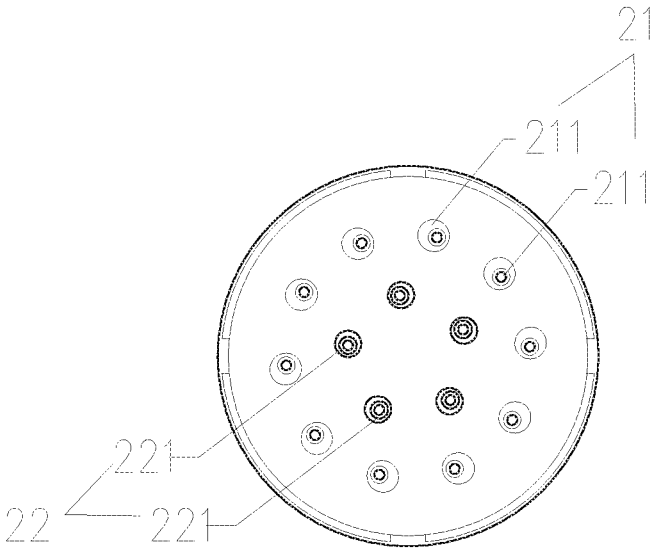
FIG. 3 illustrates a schematic diagram of the outlet cover plate of the first embodiment of the present invention.
Figure 4:
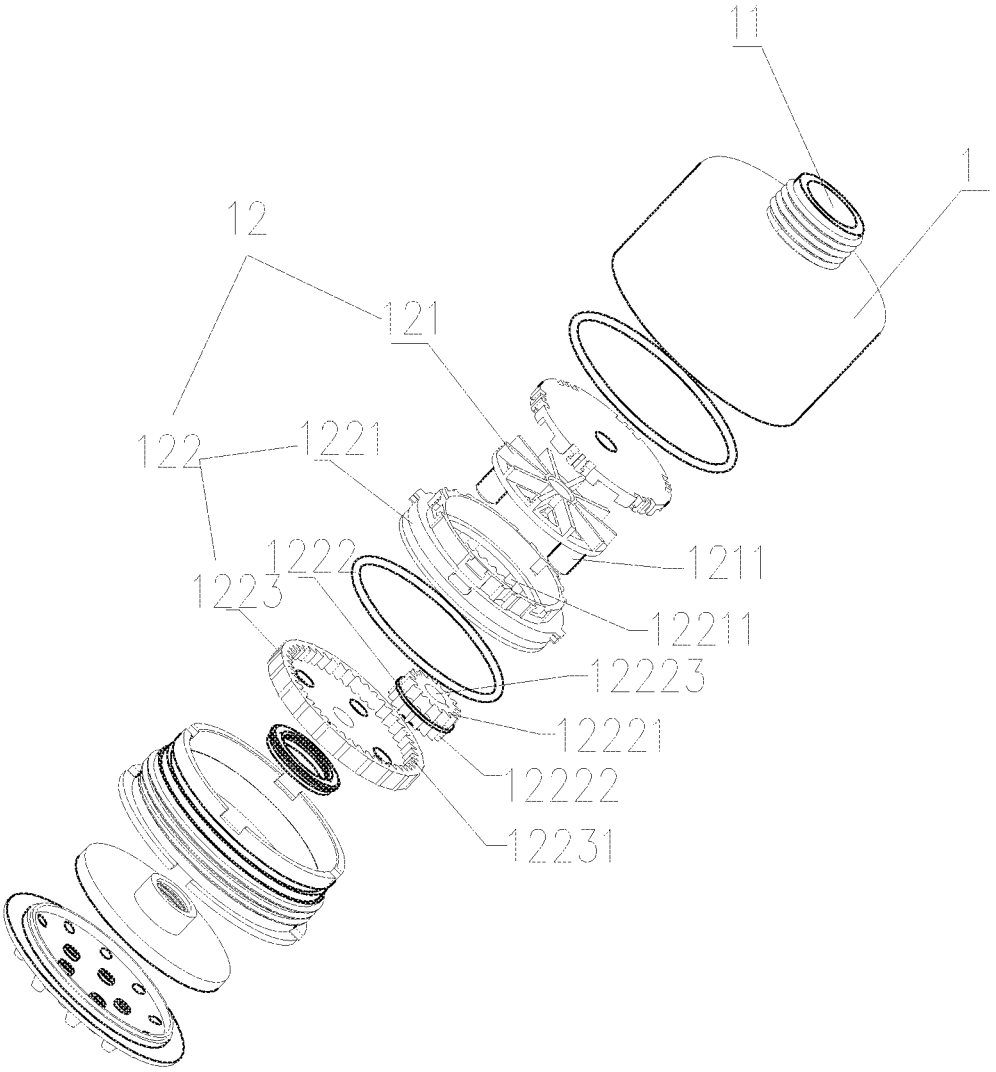
FIG. 4 illustrates an exploded and schematic diagram of the first embodiment of the present invention.
Figure 5:
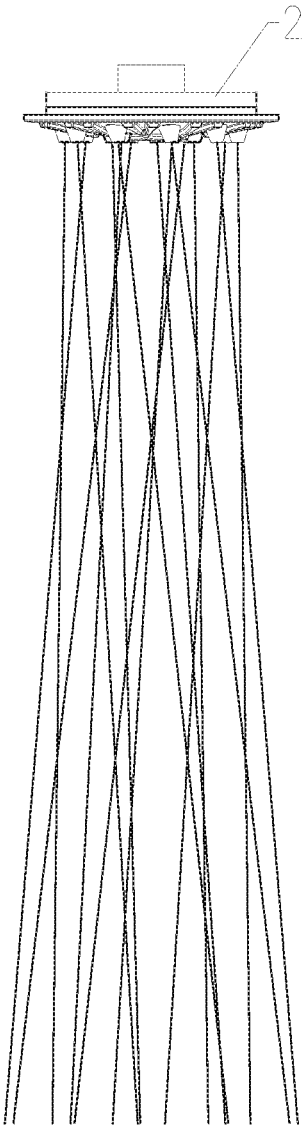
FIG. 5 illustrates a schematic diagram of the outlet effect of the first embodiment of the present invention.
Figure 6:
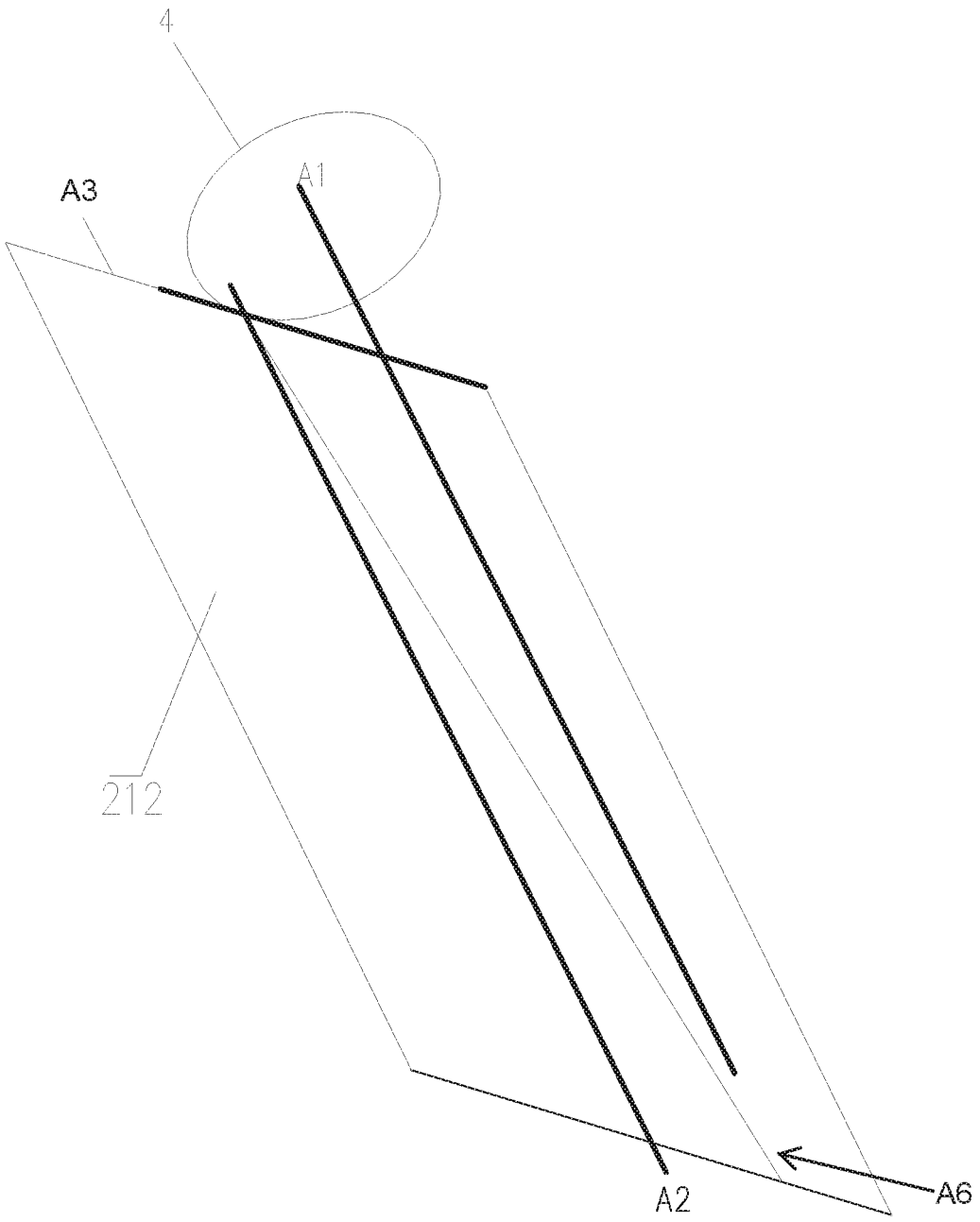
FIG. 6 illustrates a schematic diagram of the first outlet hole with the outlet direction of the first embodiment of the present invention.
Figure 7:
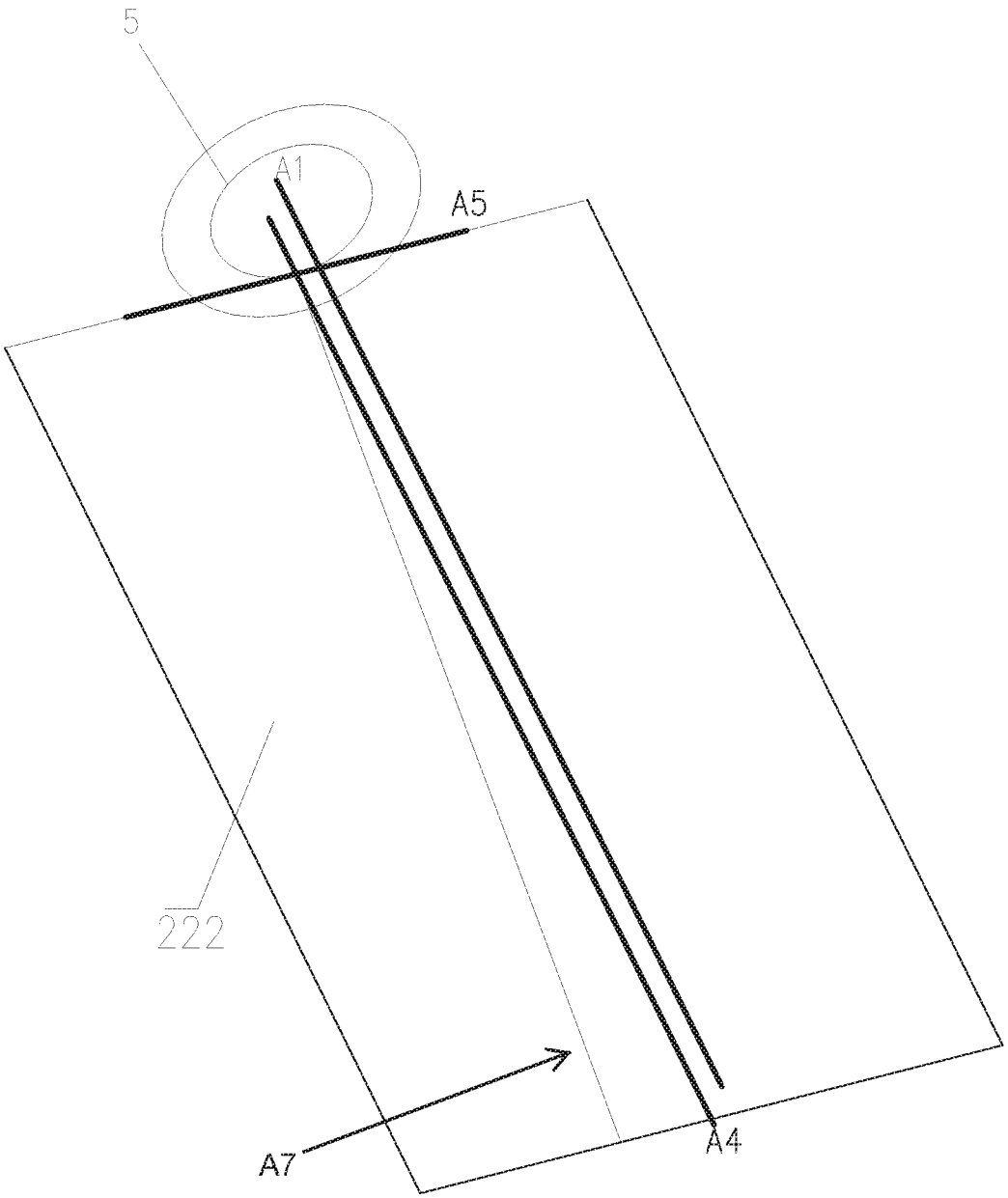
FIG. 7 illustrates a schematic diagram of the second outlet hole with the outlet direction of the first embodiment of the present invention.

The present invention will be further described with the embodiments and the drawings.

The First Embodiment:

Referring to FIGS. 1-7, a net water outlet device comprises a main body 1 and an outlet cover plate 2; the outlet cover plate 2 is disposed at one end of the main body 1, the other end of the main body 1 is an inlet end 11; the outlet cover plate 2 is disposed with a first outlet hole group 21 and a second outlet hole group 22 arranged concentrically;

therein, the outlet direction A6 of the first outlet holes 211 of the first outlet hole group 21 are configured that: all the center of the first outlet holes 211 connect into a circumference 4, the axis A1 of the outlet cover plate 2 projects to the center of each first outlet hole 211 on the circumference 4 to get A2, A2 and the tangent line A3 of the center of each first outlet hole jointly define a first plane 212, the outlet direction A6 of the first outlet hole 211 is in the first plane 212, forming a first intersection angle with A2; the outlet direction A6 of each first outlet hole 211 inclines to a same direction and is arranged in the circumference with the same outlet angle;

therein, the outlet direction A7 of the second outlet holes 221 of the second outlet hole group 22 are configured that: all the center of the second outlet holes 211 connect into a circumference 5, the axis A1 of the outlet cover plate 2 projects to the center of each second outlet hole 221 on the circumference 5 to get A4, A4 and the tangent line A5 of the center of each second outlet hole 221 on the circumference 5 jointly define a second plane 222, the outlet direction A7 of the second outlet hole 221 is in the second plane 222, forming a second intersection angle with A4; the outlet direction A7 of each second outlet hole 221 inclines to a same direction and is arranged in the circumference with the same outlet angle;

The first intersection angle and the second intersection angle are opposite with respect to the projecting direction of the axis. With this configuration, the outlet direction A6 of the first outlet hole 211 is in the first plane and inclines to the next first outlet hole 211 in the clockwise direction; the outlet direction A7 of the second outlet hole 221 is in the second plane and inclines to the next second outlet hole 221 in the counter-clockwise direction.

Therefore, the first outlet hole group 21 and the second outlet hole group 22 respectively form a group of parallel line water, the two groups of the parallel line water are in the opposite incline directions. The two groups of parallel line water intersect in space to form a mesh grid spray. The mesh grid spray is in good order, making the outlet effect attractive.

The first intersection angle and the second intersection angle are the same or different. In this embodiment, the two intersection angles are different, the first intersection angle is 7°, the second intersection angle is 4°.

In order to further beautify the mesh grid spray, the main body 1 is disposed with a flowing driving device 12, which is coaxially linked to the outlet cover plate 2; the flowing driving device 12 is driven to rotate by water flowing, such to drive the outlet cover plate 2 to rotate axially. Therefore, the mesh grid spray rotates with the rotating of the outlet cover plate 2, thus beautifying the mesh grid spray further.

The flowing driving device 12 comprises an impeller 121 and a reducing mechanism 122; the impeller 121 rotates in a first rotating rate by the driving of the water flowing, the reducing mechanism 122 rotates in the first rotating rate and drives the outlet cover plate 2 to rotate in a second rotating rate lower than the first rotating rate. This avoids the outlet cover plate 2 rotating overfast, making the interlaced outlet effect more obvious.

The reducing mechanism 122 comprises a fixing base 1221, a gear 1222 and an output gear plate 1223; the gear 1222 is linked to the impeller 121, the impeller 121 rotates to drive the gear 1222 to rotate;

the fixing base 1221 and the output gear plate 1223 are respectively disposed with a first annular gear 12211 and the second annular gear 12231 in the circumference; the gear 1222 is engaged to the first annular gear 12211 and the second annular gear 12231; as the fixing base 1221 is fixed, the gear 1222 rotates and walks along the arrange direction of the first gear rack 12211, the gear 1222 drives the output gear plate 1223 to axially rotate during the walking;

The output gear plate 1223 is disposed with an output shaft 12232 linked to the outlet cover plate 2 at the axis. So when the output gear plate 1223 rotates, the outlet cover plate 2 rotates as well.

In detailed, the fixing base 1221 is disposed with a chamber, the chamber is disposed with a first cavity and a second cavity connected to each other in the axial direction, the impeller 121 is disposed in the first cavity, the first annular gear 12211 is disposed along the inner circumference of the second chamber.

The output gear plate 1223 is disposed at the lower end of the second cavity in the axial direction; the second annular gear 12231 is disposed along the inner circumference of the output gear plate 1223; the gear 1222 is disposed with a first gear 12221 and a second gear 12222 overlapped in the axial direction, the first gear 12221 is engaged to the first annular gear 12211, the second gear 12222 is engaged to the second annular gear 12231.

The gear 1222 is disposed with an insert hole 12223 in the axial direction, the impeller 121 is disposed with an insert column 1211 faced to the gear 1222 to couple to the insert hole 12223; with the insert hole 12223 and the insert column 1211, the impeller 121 rotates and drives the gear 1222 to rotate.

Figure 8:
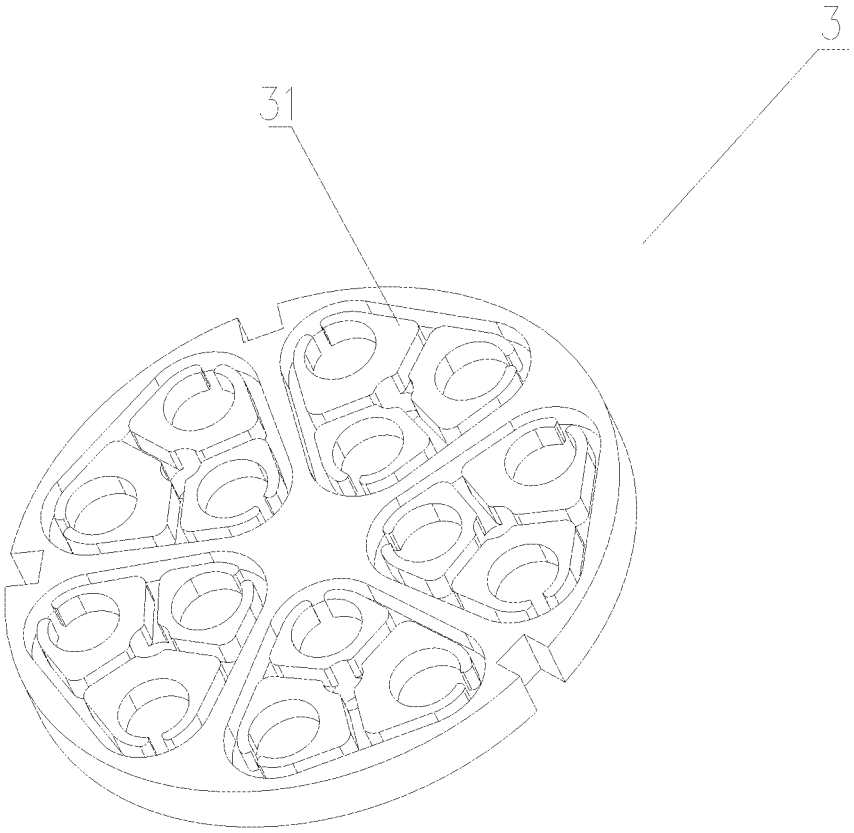
FIG. 8 illustrates a schematic diagram of the waterway guiding component of the second embodiment of the present invention.
Figure 9:
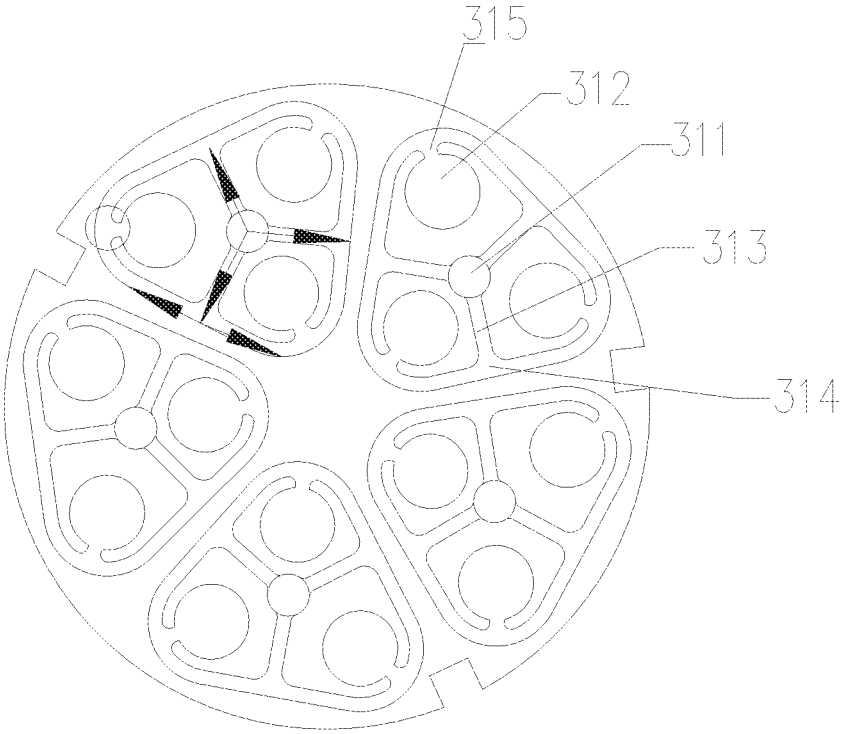
FIG. 9 illustrates a schematic diagram of the waterway guiding component with the water flowing direction of the second embodiment of the present invention.

The Second Embodiment:

Referring to FIG. 8 and FIG. 9, this embodiment differs from the first embodiment in that: this embodiment further comprises a waterway guiding component 3;

water is divided to three waterways through the waterway guiding component 3, the three waterways impact and disperse before flowing to the outlet cover plate 2. This increases the cover area of the outlet water, making the outlet device available in a large shower device, for example, a top spraying shower head.

In detailed, the waterway guiding component 3 is disposed with a plurality of waterway guiding units 31 rotatably symmetrically arranged;

each waterway guiding unit 31 comprises an inlet 311 and three outlets 312, the outlets 312 are corresponding to the first outlet hole 211 or the second outlet hole 221 of the outlet cover plate 2; the waterway guiding unit 31 comprises a diversion passage 313 and a converging passage 314; water flowing from the inlet 311 to the diversion passage 313 is divided and then converges from different directions to the converging passage 314, the converging passage 314 is disposed with a flowing hole 315 connected to the outlet 312;

Water from different directions to the conversing passage 314 impacts in the flowing hole 315 and then flows to the outlet 312. therefore, water is dispersed slightly first and then enters the outlets 312.

Furthermore, the three outlets 312 are rotatably symmetrically arranged, the inlet 311 is disposed at the circle center; the diversion passage 313 is disposed between the outlets 312 and is connected to the inlet 311; the converging passage 314 surrounds the three outlets 312, and is connected to the diversion passages 313 respectively.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A net water outlet device, comprising:

a main body, and an outlet cover plate, wherein:

the outlet cover plate is disposed at a first end of the main body, a second end of the main body is an inlet end, the outlet cover plate is disposed with a first outlet hole group and a second outlet hole group arranged concentrically, a first circumference is defined by centers of each first outlet hole of the first outlet hole group, a first outlet direction of each said first outlet hole of the first outlet hole group is in a first plane in which a tangent line of the first circumference lies, the first outlet direction forms a first intersection angle with a first line that lies in the first plane and is parallel to an axis of the outlet cover plate, a second circumference is defined by centers of each second outlet hole of the second outlet hole group, a second outlet direction of each said second outlet hold of the second outlet hole group is in a second plane in which a tangent line of the second circumference lies, the second outlet direction forms a second intersection angle with a second line that lies in the second plane and is parallel to the axis of the outlet cover plate, the first intersection angle is on a first side of the first line and the second intersection angle on a first side of the second line that is an opposite side of the first side of the first line, the main body comprises a flowing driving device that is coaxially linked to the outlet cover plate, the flowing driving device is driven to rotate by flowing water to drive the outlet cover plate to rotate axially, the flowing driving device comprises an impeller and a reducing mechanism, the impeller rotates at a first rotating rate by a driving force of the flowing water, the reducing mechanism rotates at the first rotating rate and drives the outlet cover plate to rotate at a second rotating rate lower than the first rotating rate, the reducing mechanism comprises:

a fixing base, a gear, and an output gear plate, the gear is linked to the impeller, the impeller rotates to drive the gear to rotate, the fixing base is disposed with a chamber, the chamber is disposed with a first cavity and a second cavity connected to each other in an axial direction of the chamber, the impeller is disposed in the first cavity, a first annular gear is disposed along an inner circumference of the second cavity, the output gear plate is disposed at a lower end of the second cavity in the axial direction, a second annular gear is disposed along an inner circumference of the output gear plate, the gear comprises a first gear and a second gear overlapping with the first gear in the axial direction, the first gear is engaged to the first annular gear, the second gear is engaged to the second annular gear, the gear rotates and walks along the first annular gear, the gear drives the output gear plate to axially rotate during a walking process of the gear, the output gear plate comprises an output shaft linked to the outlet cover plate at the axis of the outlet cover plate, the gear is disposed with an insert hole in the axial direction, the impeller is disposed with an insert column facing the gear to couple to the insert hole, and using the insert hole and the insert column, the impeller rotates and drives the gear to rotate.

2. The net water outlet device according to claim 1, wherein:

the first intersection angle and the second intersection angle have a same absolute value or a different absolute value.

3. The net water outlet device according to claim 1, wherein:

the first intersection angle is 7° , and the second intersection angle is 4°.

4. The net water outlet device according to claim 1, wherein:

the first outlet direction of one first outlet hole of the first outlet hole group is in the first plane and inclines to a next first outlet hole of the first outlet hole group in a clockwise direction of the first circumference, and the second outlet direction of one second outlet hole of the second outlet hole group is in the second plane and inclines to a next second outlet hole of the second outlet hole group in an counter-clockwise direction of the second circumference.

5. The net water outlet device according to claim 1, further comprising:

a waterway guiding component, wherein;

the flowing water is divided into at least two waterways through the waterway guiding component, and the at least two waterways impact and disperse before flowing to the outlet cover plate.

6. The net water outlet device according to claim 5, wherein:

the waterway guiding component comprises a plurality of waterway guiding units rotatably symmetrically arranged, each waterway guiding unit of the plurality of waterway guiding units comprises an inlet and at least two outlets, the at least two outlets correspond to the first outlet hole group or the second outlet hole group of the outlet cover plate, each waterway guiding unit of the plurality of waterway guiding units comprises a diversion passage and a converging passage, water flowing from the inlet to the diversion passage is divided and then converges from different directions to the converging passage, the converging passage is disposed with a flowing hole connected to at least one of the at least two outlets, and water from different directions converging at the converging passage impacts in the flowing hole and then flows to the at least one of the at least two outlets.

7. The net water outlet device according to claim 6, wherein:

each waterway guiding unit of the plurality of waterway guiding units comprises three outlets rotatably symmetrically arranged, the inlet is disposed at a circle center of the three outlets, the diversion passage is disposed between the three outlets and is connected to the inlet, and the converging passage surrounds the three outlets and is connected to the diversion passages respectively.

8. The net water outlet device according to claim 2, further comprising:

a waterway guiding component, wherein;

the flowing water is divided into at least two waterways through the waterway guiding component, and the at least two waterways impact and disperse before flowing to the outlet cover plate.

9. The net water outlet device according to claim 4, further comprising:

a waterway guiding component, wherein;

the flowing water is divided into at least two waterways through the waterway guiding component, and the at least two waterways impact and disperse before flowing to the outlet cover plate.

10. The net water outlet device according to claim 8, wherein:

the waterway guiding component comprises a plurality of waterway guiding units rotatably symmetrically arranged, each waterway guiding unit of the plurality of waterway guiding units comprises an inlet and at least two outlets, the at least two outlets correspond to the first outlet hole group or the second outlet hole group of the outlet cover plate, each waterway guiding unit of the plurality of waterway guiding units comprises a diversion passage and a converging passage, water flowing from the inlet to the diversion passage is divided and then converges from different directions to the converging passage, the converging passage is disposed with a flowing hole connected to at least one of the at least two outlets, and water from different directions converging at the converging passage impacts in the flowing hole and then flows to the at least one of the at least two outlets.

11. The net water outlet device according to claim 9, wherein:

the waterway guiding component comprises a plurality of waterway guiding units rotatably symmetrically arranged, each waterway guiding unit of the plurality of waterway guiding units comprises an inlet and at least two outlets, the at least two outlets are correspond to the first outlet hole group or the second outlet hole group of the outlet cover plate, each waterway guiding unit of the plurality of waterway guiding units comprises a diversion passage and a converging passage, water flowing from the inlet to the diversion passage is divided and then converges from different directions to the converging passage, the converging passage is disposed with a flowing hole connected to at least one of the at least two outlets, and water from different directions converging at the converging passage impacts in the flowing hole and then flows to the at least one of the at least two outlets.

12. The net water outlet device according to claim 10, wherein:

each waterway guiding unit of the plurality of waterway guiding units comprises three outlets rotatably symmetrically arranged, the inlet is disposed at a circle center of the three outlets, the diversion passage is disposed between the three outlets and is connected to the inlet, and the converging passage surrounds the three outlets and is connected to the diversion passages respectively.

13. The net water outlet device according to claim 11, wherein:

each waterway guiding unit of the plurality of waterway guiding units comprises three outlets rotatably symmetrically arranged, the inlet is disposed at a circle center of the three outlets, the diversion passage is disposed between the three outlets and is connected to the inlet, and the converging passage surrounds the three outlets and is connected to the diversion passages respectively.

* * * * *